United States Patent [19]

Perkey et al.

[11] 4,266,595

[45] May 12, 1981

[54] USE OF MOLD VENTING PRACTICES IN GREEN SAND MOLDING FOR ODOR REDUCTION

[75] Inventors: Conrad G. Perkey, Dearborn Heights; John L. Bell, Detroit, both of Mich.

[73] Assignee: Ford Motor Company, Dearborn, Mich.

[21] Appl. No.: 64,204

[22] Filed: Aug. 6, 1979

[51] Int. Cl.[3] ..... B22C 9/02; B22D 45/00

[52] U.S. Cl. ..... 164/41; 164/410; 164/363

[58] Field of Search ..... 164/41, 74, 253, 363, 164/410, 234

[56] References Cited

U.S. PATENT DOCUMENTS

| | | | |
|---|---|---|---|
| 1,925,479 | 9/1933 | Connor | 164/410 |
| 2,830,343 | 4/1958 | Shroyer | 164/410 X |
| 3,631,791 | 1/1972 | Harris et al. | 164/410 X |

*Primary Examiner*—Robert D. Baldwin

*Attorney, Agent, or Firm*—Joseph W. Malleck; Olin B. Johnson

[57] ABSTRACT

A method of reducing odors resulting from a ferrous metal molding operation is disclosed. A green sand molding mixture is employed having 1–2% by weight volatile organic material. The mold is provided with manifold-type channels each 0.5 inch in diameter which extend between the upper mold surface to a distance 1–2 inches from the mold cavity. The channels are spaced apart a distance 2–10 inches and at least one of the channels is located 2.5 inches from a pouring basin so that during a metal pouring operation all of the gas flows exiting from said channels will be autoignited and reduce odors by at least 50%.

7 Claims, 2 Drawing Figures

USE OF MOLD VENTING PRACTICES IN GREEN SAND MOLDING FOR ODOR REDUCTION

BACKGROUND OF THE INVENTION

In the conventional green sand molding process, sand, 5–6% by weight (all mixture percentages hereinafter shall mean by weight unless specifically noted otherwise) clay, about 1–2% cereal, about 2–5% water and a 4–5% lustrous carbon producing material (such as seacoal, No-col, etc.) are mixed together to form a moldable material. The lustrous carbon material contains 30–35% volatile organic compounds with about 58% fixed carbon, 7% ash, 1% sulfur and some water. No-col contains about 25% organic material and the remainder clay. In each of these lustrous carbon producing materials the organic materials play an important role because they form a soot which prevents surface defects of the casting caused by micropores and cracks in the mold surface.

The prepared sand mixture is typically transferred to a mold line where it is placed into the bottom half of the mold and an impression of the part to be produced is made in the sand. A similar procedure is followed with the top half of the mold. A pour basin and sprue is also defined in the mold parts (halves) which communicate with the impression or mold cavity. The two halves are placed together with the pouring basin on the top for receiving molten metal. Other pin holes may be punched in the top half to facilitate a limited amount of gas venting during the casting operation, such holes being no greater in diameter than 0.125 inches. Molten metal is then poured into the basin, through the sprue and into the mold cavity to take the shape of the impression in the mold. When the hot metal is poured into the mold, there is combustion of the organic material in the mold sand as well as in the cores, until the air supply is depleted, then volatilization and partial breakdown of such organic material occurs. The gases formed as a result of such volatilization are quite odorous and some escape from the mold through said vent holes and some escape when the mold is opened to remove the casting. These gases are objectionable not only to the in-plant personnel, but to others in the environment to which the gases are exhausted outside of the plant.

The prior art has attempted to solve only the in-plant personnel problem by quickly collecting the gases such as by vacuum devices which gather the gases rapidly during the molding operation and transmit such gases to baghouses and other exhausting apparatus. However, such attempts do not solve the problem of eliminating the odors which eventually find their way into the surrounding environment; there is increasing concern by governmental agencies which prohibit such gas dumping. What is needed is a mechanism or process by which such odorous gases (containing unburned hydrocarbon from the lustrous carbon producing material) can be substantially eliminated, not merely collected or masked.

SUMMARY OF THE INVENTION

A primary method of this invention is to provide an improved method for reducing odors associated with casting of molten metal in green sand. A specific aspect of this object is to significantly reduce the odors originating with gases evolved from volatilization of organic matter upon contact with molten metal, the odor being significantly reduced both within the plant in which said casting is carried out and in the environment surrounding said plant. The odor content of said exhaust gases is reduced by over 50%.

Another object of this invention is to provide an improved method for casting metals in the foundry in green sand molds, said processing being characterized by better process controls to reduce sand carry-out as well as reduce the required moisture range for the green sand molding mixture.

Features pursuant to the above objects comprise the use of: (a) large vent channels in the green sand mold to act as a series of burner flues, each with sufficient gas transport to permit self ignition transferred from one ignited vent to an adjacent unignited vent, (b) a pool of molten metal in the inlet basin for the mold to serve as the ignition means for gases blowing from the most adjacent vent, (c) a controlled mixture for said green sand molding which consists of 5–6% clay, about 0.1–0.2% cereal, less than 3% water, and 1–2% organic volatile material.

DETAILED DESCRIPTION

Figure 1:
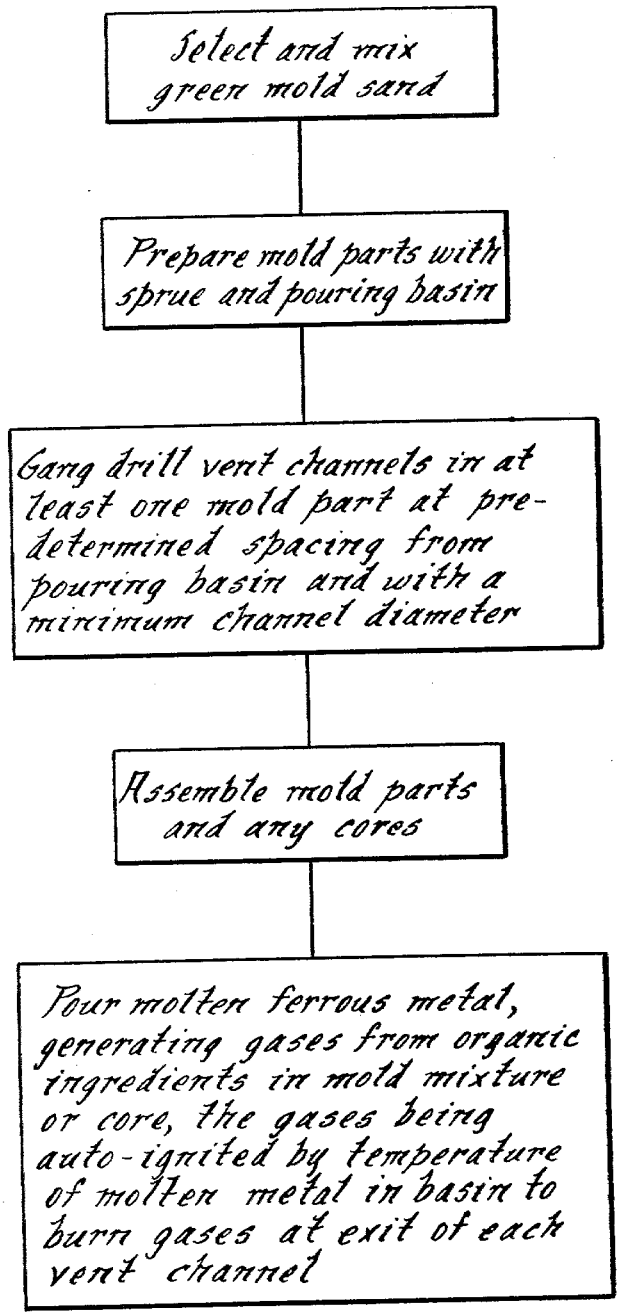
FIG. 1 is a schematic elevational view of a molding apparatus effective to carry out the inventive mode of this invention.
Figure 2:
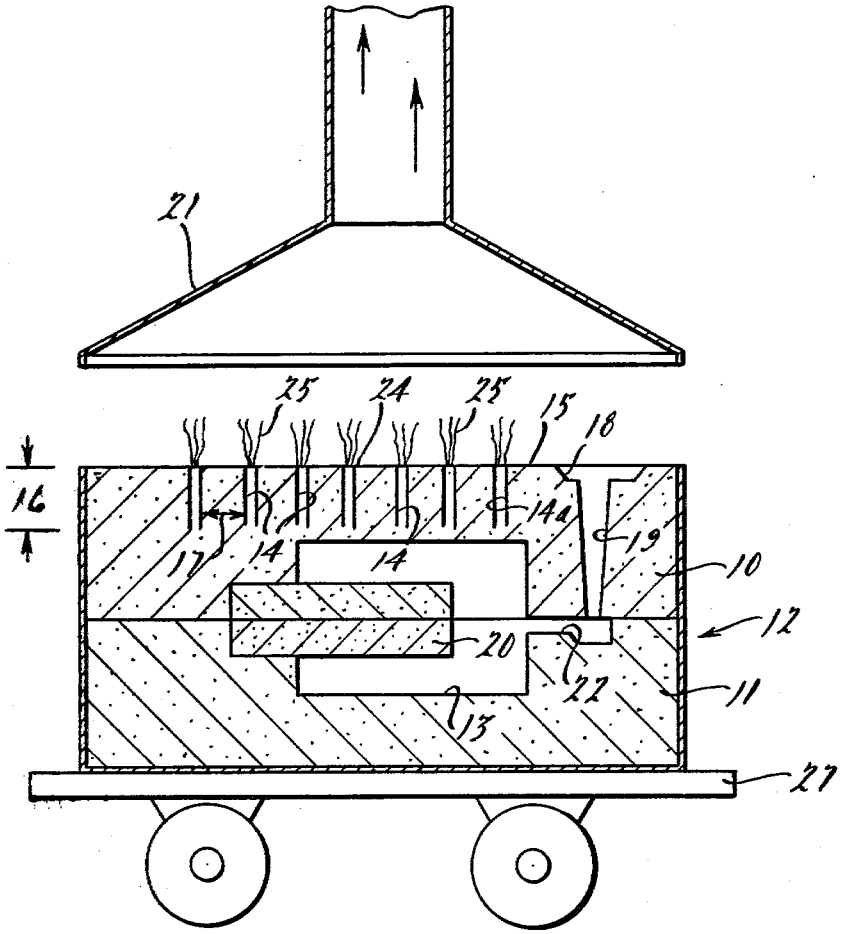
FIG. 2 is a schematic flow diagram of a preferred method sequence of this invention.

In a preferred mode (as shown in FIGS. 1 and 2) for carrying out the method aspects of the present invention, the following steps are employed:

(1) The ingredients for a green sand molding mixture are selected and comprise: 5–6% clay, about 0.1–0.2% cereal (cereal may consist of corn material or equivalent), 2.5% water, 4–5% lustrous carbon producing material, and the remainder being sand. The lustrous carbon producing material should consist of sea coal, or NoCol. Sea Coal typically contains 30–35% volatile organic material, 57% fixed carbon, 7% ash and about 1% sulfur. In NoCol, 25% organic combustable material is present and the remainder is 75% clay. In each case, the lustrous carbon producing material is extremely useful because the organic portion thereof burns and creates soot which coats the interior mold face creating a very fine finish on the surface of the casting; the effect of micropores in the mold surface and wetting of the sand surface of the mold by iron are reduced.

Unfortunately, the gaseous organic material creates odors. Upon combustion of some of the organic material, there is some portion that remains volatile but uncombusted and is carried away by the generated gases. These gases, being extremely odorous, create an undesirable working condition as well as contamination of the atmosphere into which the gases are exhausted.

The ingredients then are mixed in a typical mulling device and thoroughly blended to a sufficient green strength that is easily molded.

(2) The prepared mixture is transferred to the mold line where the cope 10 and drag 11 for a typical mold assembly 12 are prepared. The sand is placed into the forms for each of the cope and drag and an impression is made in each sand part to complete a mold cavity 13. A sprue channel is also defined along with an accompanying pouring basin, the sprue channel communicates with the mold cavity.

(3) The top half of the mold (cope 10) is placed so that its back side is up; a gang of drills is moved into position so that a plurality of channels 14, approximately ½ inch (and no less than 0.4 inches) in diameter, are drilled through the outer face of the mold half 10 to a depth 16 of 9–11 inches so that they will be spaced approximately 1–2 inches from the mold cavity 13. The channels 14 are located by the gang fixture so that there is a spacing 17 between channels of no greater than 10 inches (but no less than 2 inches); at least one of the channels 14*a* is located so that it is spaced no greater than 2.5 inches from the pouring basin 18 or sprue 19 so that it may be auto-ignited by molten metal in the basin. The plurality of vent channels 14 are arranged so that they extend over substantially the entire upper portion of the mold cavity, the combined total cross sectional area of the vent channels being related to the projected cross sectional area of the mold cavity and cores in a ratio of 10:1.

Then mold halves are assembled with the implantation of appropriate cores 20; the cores contain a sand mixture which also have resins and other organic combustable material. The halves are placed together so that the pouring basin 18 and sprue 19 are located in the top of the assembly; an exhaust hood 21 is placed over and proximate to the plurality of vent channels and pouring basin.

(5) Ferrous molten metal of about 2600°–2700° F. is poured into the basin 18 and carried through the sprue 19 to a horizontal runner 22 and thence into the mold cavity 13 where it contacts the molding and core sand containing the volatile material. Gases are generated upon heating by the hot molten metal. The combined gas generation from both the molding sand and the cores produce a gas flow through each of the vent channels 14 of at least 5 cubic feet per minute. The gases contain some unburned hydrocarbons and escape through the drilled vent channels 14 to be autoignited at the channel exits 24 at at the mold exterior surface 15 by the heat of the molten metal in the pouring basin. This first takes place by gases, eminating from the first channel 14*a* being ignited by the proximate heat of the metal in the basin; additional vents are ignited by heat being transferred to the next adjacent gas flow 25 eminating from the next vent channel. Thus, in a domino relationship, each of the gas flows are ignited until all of the exhaust gas flows are flaming. The gas flow will continue for approximately 4 minutes and will of course decrease in quantity and eventually the flames associated therewith will extinguish.

The entire mold assembly 12 is typically moved into position under the hood 21 by a mold reel car 27. The suction in the hood will drive an exhaust flow of about 30,000–40,000 CFM. With this level of exhaust flow, auto ignition is essential to dissipation of odors.

We claim:

1. A method of reducing odors resulting from a molding operation, comprising:

(a) preparing a sand mixture containing 1–2% by weight of volatile combustable organic material, (b) compacting the sand mixture to define a mold and mold cavity, shaping the compacted sand to define a series of vent channels in said mold leading from the mold exterior to the mold interior but spaced a distance of 1–2 inches from the mold cavity, each of said vent channels being spaced from one another a distance no greater than 10 inches, and said mold cavity having a pouring basin and sprue associated therewith leading from the upper surface of said mold to said mold cavity, at least one of said vent channels being located a distance from said pouring basin no greater than 2.5 inches, and (c) introducing molten ferrous metal to said pouring basin effective to fill said mold cavity, said molten metal heating volatile ingredients in said sand mixture to generate gases, said gases exiting through said vent channels and being auto-ignited by the temperature of the molten metal in said pouring basin, said ignited gases being consumed and combusted so as to reduce the odorous character of the exhaust gases by at least 50%.

2. The method as in claim 1, in which the molten metal is at a temperature of at least 2600° F.

3. The method as in claim 1, in which each of said vent channels having a diameter of no less than 0.4 inches.

4. The method as in claim 1, in which the sand mixture contains 5–6% by weight clay, about 0.2% by weight cereal, about 2.5% by weight water and about 5% by weight lustrous carbon producing material, the remainder being sand.

5. The method as in claim 1, in which said mold additionally contains at least one core constituted in part of a combustable organic material which additionally yields generated gases of an odorous nature, the combined gas generation from both said cores and molding sand producing a gas flow through each of said vent channels of at least 5 cubic feet per minute.

6. The method as in claim 4, in which said lustrous carbon producing material is comprised of Nocol having about 75% by weight clay and 25% by weight organic volatile material.

7. The method as in claim 1, in which the plurality of vent channels are arranged so that they extend over substantially the entire upper portion of the mold cavity, the combined total cross sectional area of said vent channels being related to the projected cross sectional area of the mold cavity and core in a ratio of 10:1.

* * * * *